United States Patent [19]

Worsham

[11] 3,979,117

[45] Sept. 7, 1976

[54] FOOTBALL DART BOARD GAME

[76] Inventor: Ronald E. Worsham, 2410 Bluebonnet, Houston, Tex. 77025

[22] Filed: May 14, 1973

[21] Appl. No.: 361,097

Related U.S. Application Data

[63] Continuation of Ser. No. 160,687, July 8, 1971, abandoned.

[52] U.S. Cl. ..... 273/102 B; 273/134 CF; 273/94 R

[51] Int. Cl.[2] ..... A63B 71/02

[58] Field of Search ..... 273/95 R, 94 R, 102 B, 273/134 CF

[56] References Cited

UNITED STATES PATENTS

| | | | |
|---|---|---|---|
| 1,838,398 | 12/1931 | Heidbrink | 273/94 R |
| 2,227,382 | 12/1940 | Salter | 273/102 B |
| 2,276,599 | 3/1942 | Tassano | 273/94 R |
| 2,454,891 | 11/1948 | Spause | 273/94 R |
| 2,587,242 | 2/1952 | Stringer | 273/94 R |
| 3,630,522 | 12/1971 | Bear | 273/94 R |

*Primary Examiner*—Richard C. Pinkham
*Assistant Examiner*—Marvin Siskind
*Attorney, Agent, or Firm*—Jack W. Hayden

[57] ABSTRACT

The game comprises dart boards with distinctively colored dart target area designations representative, when dart pierced, of occurrences that can result from selective offense plays as running, pass, and kick plays, player change from dart thrower to watcher being dictated in correspondence with target area reflected results corresponding with change from offense to defense in actual football.

1 Claim, 2 Drawing Figures

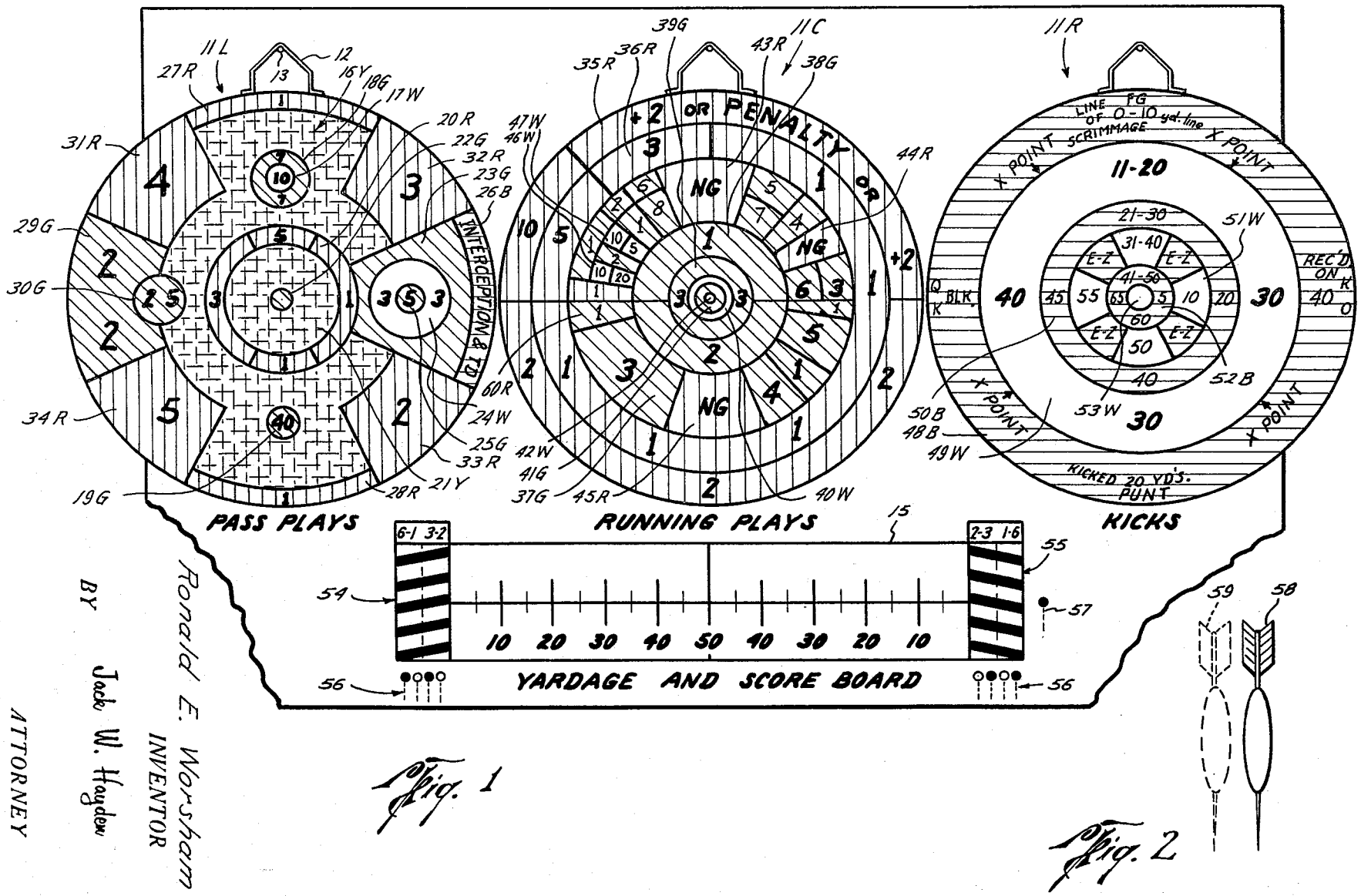
Ronald E. Worsham
INVENTOR
BY Jack W. Hayden
ATTORNEY

FOOTBALL DART BOARD GAME

CROSS REFERENCE TO RELATED APPLICATION

This is a continuation of application Ser. No. 160,687 filed on July 8, 1971 for "Football Dart Board Game" and now abandoned.

BACKGROUND OF THE INVENTION

Some of the problems raised by other dart board games may result from the requirement of a multiplicity of darts to be thrown successively by one player for a predetermined number of throws, or a number of relatively movable accessary parts may be required as special markers, flags, lights, scoreboard, audible signals, clocks, and timers, and the like. Mainly, the occurrence of results indicated by moves or throws is often far from reflective of the actual proportionate occurrence of the thrown dart reflected results as they actually happen in true life play of the games represented. No special dart board game has been devised where a single dart may be used by one player until after a succession of throws of varying number, posession of the throwing dart is given over to the opposing player in correspondence with the varying lengths of time between changes from offense to defense in football games.

Also, no football dart game has been heretofore provided with dart board spaces or target area designations in such dart board area distribution that are representative of the vast number of complicated occurrences, and their proportionate occurrence in actual football.

SUMMARY OF THE INVENTION

The invention resides in a plurality of dart boards with target areas selectively allotted for the selection of running, passing, and kick plays by the active player representative of the offensive side quarterback, with the space or target area allotment endeavoring to reflect, at least in part, in proportion to their possible actual occurrence, the vast numbers of complicated occurrences of football. Thus, illustratively, the player, or dart thrower, aims the dart selectively at, and endeavors to hit, target areas reflecting running play results, pass play results, and then, as when the results indicate an offensive team should kick, as, for example, on fourth down, the player aims at target areas representative of kick plays, and the results of such an aim and throw determines the result of the kick play.

Corresponding with such sequence, that is, corresponding with "the ball going over" to an opposing side after a kick play, the opposing player then becomes the dart thrower with the ball on the yard line indicated by the throwing of the thrower, now becomes the watcher. For best selectivity, three dart boards are best provided, one of which is provided with target areas designative of running play results, another having target areas designative of passing play results, and the third having target areas designative of kick play results. A representative yardage board may be provided as an accessory to keep represented ball positions thereon, and to keep score on by any suitable means such as pin means or thumbtacks.

As a primary object, the invention sets out to provide a football dart board game that provides dart target areas for a dart thrower, representative of offensive quarterback that may be proportionately struck by the dart thrower in correspondence with the proportion actual occurrence of the occurrences represented in actual football.

It is also an object of the invention to provide a football dart board game of this class that provides convenient arrangement for the selection of offensive plays results represented by target area pierced by dart in correspondence with the football types of running, passing, and kick plays.

It is another object of the invention to provide a football dart board game of this class which requires a minimum of working parts with only one dart being required to be thrown at a selected target area with whatever target area that is struck (the selected are or otherwise) being indicative of the results of a called offensive football play.

It is a further object of the invention to provide a football dart board game of this class which includes three separate, aligned dart boards, respectively, for running, passing, and kick plays, with respective dart board target areas thereon.

It is consequently another and important object of the invention to provide a football dart board game of this class in which the scores obtained by two opposing players may be indicative of their respective dart throwing skill and play selection skill, in combination.

Other and further objects of the invention will be apparent when the specification hereinbelow is considered with relation to the hereinbelow described drawings.

BRIEF DESCRIPTION OF THE DRAWINGS

FIG. 1 is a front elevational view of an embodiment of apparatus for playing the football dart board game; and FIG. 2 is an elevational view of a typical dart used by the thrower in play, the view also including an additional dart in dotted lines as representative of the plurality of darts that may be employed.

DESCRIPTION OF THE PREFERRED EMBODIMENT

The drawings shown in alignment on the left a PASS PLAYS dart board 11L, a center or RUNNING PLAYS dart board 11C, and on the right a KICKS dart board 11R. Each has a suspension hook or loop 12 connected to the top portion thereof to be suspended from a nail 13 driven into a backboard 14 against which rests the rear surfaces of the respective dart boards. Below the dart boards is symmetrically located a yardage board 15 with longitudinally equally spaced apart vertical lines representative of the conventional football field 10 yard lines, as 40, 30, 20, 10, and goal line, from either side of a central 50 yard vertical line. Also, shorter equally spaced between the vertical lines between the 10 yard designating lines are representative of 5 yard distances. After the goal line designating vertical lines at each end of the football playing field designating area are shown gridded areas to be hereinbelow described.

The respective dart boards may be of balsa, cork, or any suitable wood or plastic for the purpose. Optionally, although not shown, a metallic ring may be extended around and affixed to the peripheries of the respective dart boards, and to which the aforesaid hooks, loops, or hangers 12 may be removably affixed at their lower ends. The yardage board 15 may be painted upon, or a separate board affixed to the backboard 14.

The PASS PLAYS dart board 11L has generally disposed about its vertical axis a central area 16Y, show colored yellow, which upwardly centrally comprises the outer portion of substantially a 55° segment of a circle, centrally therebelow comprises an interrupted annular area and therebelow comprises centrally the outer portion of substantially a 55° segment of a circle. However, the angle of the segment may be increased or decreased as desired on any given dart board.

Within the upper central portion of the yellow colored central area 16Y and about the vertical axis of the dart board 11L is white circle 17W with numeral 10 therein, while a green annulus 18G surrounds the white circle 17W, the numerals 7 being carried in the green annulus 18G, one above and one below the white circle 17W. Oppositely, downwardly, centrally within the lower central portion of the yellow colored area 16Y and about the vertical axis of the dart board 11L, a green circle 19G is provided with the numeral 40 therein.

Concentric within the yellow colored annular portion of the area 16Y, a red annular area 20R is provided divided by radially extending white lines into an upper, substantially 55 degree arcuate portion with numeral 5 therein, a right side, substantially 125° arcuate portion with numeral 1 therein, a lower, substantially 55° arcuate portion with letter I therein, and a left side, substantially 125° arcuate portion with numeral 3 therein. Concentric within the red annulus 20R a yellow annulus 21Y is provided, and the very central area of the dart board 11L, within the yellow annulus 21Y, comprises a green "bull's eye" or center 22G.

The annular portion of the yellow area 16Y is interrupted centrally rightwardly from the periphery of the red annulus 20R by a partial green segment 23G of substantially 55° which extends outwardly into the proximity of the dart board periphery. Centrally within this partial segment a white annulus 24W is provided with a green circle 25G therein carrying the numeral 5, oppositely disposed numerals 3 being provided within the white annulus 24W on inner and outer sides of the green circle 25G.

Outwardly of the green partial segment 23G a narrow, blue, arcuate, peripheral area 26B is provided with the designation INTERCEPTION & TD therein. Above the upper portion of the yellow area 16Y is the narrow, red yardage loss, or intercepted pass, arcuate peripheral area 27R with a value of 1, and below the lower portion of the yellow area 16Y is the narrow, red yardage loss, or intercepted pass, arcuate peripheral area 28R, with a value of 1.

Centrally leftward of the annular portion of the yellow area 16Y a green partial segment 29G, subtending approximately 55°, extends to the periphery and has a numeral 2 in each of the upper outer and lower outer portions thereof. Also a green circle 30G, having numeral 25 therein, is interjected centrally inwardly, partly within the green partial segment 29G, and partly disposed centrally within the central, left marginal area of the yellow area 16Y.

The dart board 11L is completed by four red partial segments 31R, 32R, 33R, and 34R, each subtending substantially 35° from the periphery, and disposed, respectively, at upper left, upper right, lower right, and lower left. These red areas 31R, 32R, 33R, and 34R carry therein, respectively, numerals 4, 3, 2, and 5. A description of the rules of the game as affected by dart strikes lodging in the hereinabove described areas is not set forth at this point, but all such lodgements are to be interpreted in results represented in relation to the selection of pass plays by the dart throwing player in simulation of offensive quarterback.

The dart board 11C, or RUNNING PLAYS dart board, is comprised of an outermost or peripheral red annulus 35R, and successively inwardly thereof a red annulus 36R, an interrupted, complex, green annulus 37G, a green annulus 38G, a green annulus 39G, a white annulus 40W, a green annulus 41G, and a "bull's eye" or white, central circle 42W. From the 10:30 line around to the 3 o'clock line, the outermost red annulus 35R is divided into a substantially 135° area designated "+2 OR PENALTY OR +2". From thence, around clockwise, the red annulus 35R has a substantially 180° area having three equally, angularly spaced apart numerals 2 therein; then from the 9 o'clock line to the 10:30 line the red annulus 35R has a substantially 45° area having the numeral 10 therein.

The red annulus 36R, from top, or 12 o'clock clockwise, has a substantially 270° area having five equally angularly spaced apart numerals 1 therein, a substantially 45° area having numeral 5 therein, and in completion a substantially 45° area having numeral 3 therein.

The interrupted, complex, green annulus 37G is interrupted centrally at the top by a substantially 40° red area 43R having the letters NG therein and successively clockwise therearound this annulus 35G has a divided outer and inner green partial segment subtending substantially 20° and having numeral 5 in the outer portion and numeral 7 in the inner portion thereof, then a substantially 12 ½° green partial segment having the numeral 4 therein. Continuing clockwise, the annulus 37G has an interrupting, substantially 15° red partial segment 44R having the designating letter NG therein, then a substantially 22 ½°, divided, outer and inner green partial segment having numeral 3 in the outer portion and numeral 6 in the inner portion.

Continuing clockwise with the interrupted, complex, green annulus 37G, it has successively four green areas of, respectively, 8 ½°, 27°, 12 ½°, and 27°, having, respectively, numerals 1, 5, 1, and 4 therein, then centrally, downwardly an interrupting red, 30° area 45R having the letters NG therein, then a green area of substantially 67 ½° having the numeral 3 therein, and a green area of substantially 10° having the numeral 1 therein, and thereafter an interrupting red area 60R of substantially 10° having the numeral 1 therein. There follows, in clockwise direction, a most complex area of substantially 33°, with the outer third part comprising a green area of substantially 33°, with a first interrupting white area 46W inwardly thereof divided into an outer portion having the numeral 10 therein, and an inner portion having the numeral 20 therein, this white area 46W subtending an angle of substantially 12 ½°; following, centrally inwardly of the aforesaid substantially 33° subtending, outer green area, there is a green area of substantially 8° having the numeral 2 therein, and next, inwardly of the upper part of the aforesaid substantially 33° subtending, outer green area, there is an interrupting white area 47W subtending an angle of substantially 12 ½°, and being divided into an outer part having the numeral 10 therein, and an inner part having the numeral 5 therein. There follows a green area subtending substantially 13 ½° and being divided into an outer area having the numeral 2 therein and having an inner area having the numeral 1 therein.

Then, completing the annulus 37G, there is a green area subtending substantially 13 ½° and being divided into an outer area having the numeral 6 therein and an outer area having the numeral 8 therein.

The green annulus 38G is divided along the horizontal center line into an upper area having numeral 1 therein, and a lower area having the numeral 2 therein. The green annulus 39G has a numeral 3 centrally on the left, and a numeral 3 centrally on the right.

The KICKS dart board 11R provides outwardly a blue annulus 48B, and successively inwardly therefrom, a white annulus 49W, a blue annulus 50B, an interrupted white annulus 51W, a blue annulus 52B, and a "bull's eye" or white circle 53W at center. At top, the blue annulus 48B has the notations FG-LINE OF SCRIMMAGE-0-10 YD. LINE, and in clockwise direction therearound in respective 3 o'clock, 6 o'clock, and 9 o'clock areas, the outer blue annulus 48B has therein the respective notations: RECEIVED ON 40-KO; KICKED 20 YDS. - PUNT; and QK - BLK. Also intermediate the aforesaid notations in respective 1:30, 4:30, 7:30, and 10:30 o'clock areas, the outer blue annulus 48B has therein the notations: X POINT with arrowhead to the periphery of the white annulus 49W therewithin.

Within the white annulus 49W, in respective 3 o'clock, 6 o'clock, 9 o'clock, and 12 o'clock areas, this annulus has therein, respectively, notations 30, 30, 40, and 11–20. Within the blue annulus 50B in respective 3 o'clock, 6 o'clock, 9 o'clock, and 12 o'clock areas, this annulus has therein, respectively, notations 20, 40, 45, and 21–30. Within the interrupted white annulus 51W at top a substantially 55° white area with notation 31–40 therein, and alternately, successively therearound interrupting, substantially 35° blue areas having notations EZ therein, and substantially 55° white areas having successively therein numerals 10, 50, and 55 therein. Within the blue annulus 52B, numerals successively clockwise therearound from top 41 50 are 5 right, 60 bottom, and 65 left.

The construction of the dart boards 11L, 11C, and 11R having been described, the dart throwing player is projected, illustratively, as the offensive quarterback whose team has the ball with first down beginning on its own 20 yard line, at the start of a game. The first play will dictate itself to be a running play so he takes his place before the center dart board 11C. All green areas struck (outwardly of the annulus 41G) reflect yardage gained, with all white areas reflecting a runaway play with basic yardage gained as indicated by the numeral therein and warranting a bonus throw. Also, the small green annulus 41G reflects a runaway play with bonus throw, the basic yardage being 30 yards. The white central or "bull's eye" circle 42W represents a touchdown. The white annulus 40W reflects a runaway play with a basic 3 yards gain plus a bonus throw. Red areas reflect the yardage loss indicated by the numerals in the respective areas, no gain, in the case of those areas have NG therein, and choice of a penalty or a 2 yard gain in the case of red area of the outer red annulus 35R so designated. Thus, as the turn of his skill suggests, the dart thrower (offensive quarterback) may throw centrally on this first play, taking chance on his accuracy resulting in a high rated runaway play award, or touchdown, or else, probably at the upper left center area, whereby shorter runaway play target areas are interspersed with shorter, but generally fair awarding green areas. If, after two dart throws at the dart board 11C, his totally accrued yardage is only 6 or 7 yards, he may shift to face the dart board 11L where the target area arrangement is such, as the 24W, 22G areas, right center, as his feel of degree of skill may dictate, where there can be higher assurance of his throw resulting in at least the yardage for a total of at least 10 to make a first down. This is in correspondence with illustrative problems that face a quarterback when he projects the call of a play on the likelihood of yards to be gained (his skill), against the capacity of the opposition (the dispersion of variously favorable among unfavorable target areas).

If the first three throws (plays) accrue in gainage of a first down, the dart thrower is again faced with corresponding problems as faced at the beginning of the aforesaid sequence. If, say after three throws (plays), his yardage gain is 9 yards, he may gamble on the selection on the dartboard 11C of a fairly large target area, as 37G, 38G, lower left central areas, where there is the best likelihood of his gaining the reflection of the award of that yardage necessary to make out a first down. Or, if at the end of three throws (plays), the accrued yardage leaves too much chance of failing to complete first down yardage by a fourth throw at any specific target area on either the dart board 11C or 11L, the dart thrower (quarterback) moves to face the dart board 11R which offers target areas reflective of kicks and the results following.

Facing a punting situation, the thrower simply has to aim at the center of the dart board 11R whereby if the dart strikes within the blue annulus 52B, the ball is advanced 60 yards from the yard line advanced to on the first three throws (say the 27 yard line in the situation assumed). If the dart strikes the white "bull's eye" 53W, then the play is treated as a fake punt which scores a touchdown. The punt portion of the board is represented by that portion of the dart board which is at 6 o'clock. Therefore, if the dart does not hit a "bull's eye", but in any of the respective areas of the interrupted white (and blue) annulus 51W the punt is for 50 yards, since the dart thrower is "punting" and since the punt plays are represented at 6 o'clock on the board. If the punt throw strikes still further outwardly of the center of the dart board 11R, the punt is represented as going 40 yards (that portion designated 50B — with 40 in the 6 o'clock position on the board), and likewise 30 yards (if the dart hits in the portion designated 49W), or 20 yards if the dart hits in the circle designated at 48B. Missing the board altogether is representative of the opposition blocking the punt and taking over. Let us assume that the punt play dart throw strikes in the blue annulus 50B, representative on the 6 o'clock line of dart board 11R, as a punt that travels 40 yards to the 33 yard line of the heretofore watching player.

The new dart thrower (heretofore opposition quarterback or beginning player) now faces the center dart board 11C, and the situation of what to do with the ball received on his 33 yard line. In a punt return situation, any strike in green areas results in the number of the struck area being doubled as return yardage. If, say, the dart representing the punt return should strike in the interrupted 37G annulus, lower right green area with the numeral 4 therein, this number is doubled as a punt return of 8 yards, and the ball is now on the 41 yard line of the team taking over, at the start of first down.

Having graphically described a representative succession of typical plays of the game, the usage of the respective boards may be further described generally as to the application of the variously colored, sized, and disposed areas thereof as the rules interpret respective dart strikes in these areas in terms of football events resulting therefrom.

On the center board 11C (exclusive of for punt returns and run backs of kick offs), strikes in green areas result in the gain indicated by the numerals shown in the respective area. A strike within the small green annulus 41G is representative of a 30 yard gain plus a bonus throw.

Strikes in red areas reflect yardage loss or no gain in accordance with the numeral or NG letters in these respective areas. A strike within the "+2 OR PENALTY OR +2" area of the outer red annulus 35R gives the party representing the defense (the watcher), the choice of limiting the offensive team (dart thrower), to a 2 yard gain on a down that counts, or to a penalty. If the penalty results from a play from scrimmage, the penalty is loss of 5 yards to the offense, but the play does not count as a down. On occasions other than from scrimmage, when the penalty area is struck, and the defensive side selects the penalty, it is 15 yards.

On this center board 11C, a strike in the white center 42W represents the making of a touchdown, while a strike in the small white annulus 40W represents a gain of 3 yards plus a bonus throw. A strike in any of the other white areas represents a gain of the yardage indicated by the numerals therein, plus a bonus throw. It is also reiterated that a strike within the small green annulus 41G is entitled to a bonus throw.

The bonus throw is awarded generally with the object of giving more reality to the yardage representative of the greater gains made on breakaway plays. If on bonus throws red areas are struck, no extra yards are added or subtracted for such throws. If the green area is struck, the bonus yardage is the yardage represented therein, or as designated therefor. If a white area is struck on bonus throw, the added yardage is as represented therein or as designated therefor. There are bonus throws upon bonus throws. If the bonus throw is for a target strike made as representative of a kickoff return or run back of a punt, the yardage representative of the strike made by the bonus throw is doubled. Here again, however, there would be further bonus throw granted if the bonus throw should strike a white area.

In case the thrown dart misses the board at which it is thrown, this event is representative of a fumbled ball. Then the opposing players throw competitively (as at the target circle area 42W, 11C), and the one whose throw is closest to the center represents the team that has recovered the fumble. The ball is considered placed back in play in the last point of scrimmage, but a down is counted.

Similarly, on a passing play, missing the dart board 11L is representative of an interception by the opposing team 10 yards from the line of scrimmage and the opposition takes over.

On the drt board 11L, any strike within a yellow area (16Y and 21Y) represents an incompleted pass. All red areas represent loss of yardage indicated by the numerals therein except that in the case of the lower part I of the red annulus 20R, an intercepted pass is represented down field 40 yards from the line of scrimmage. Then resort is made to the center dart board 11C to establish the run back or return of the intercepted pass to be determined by the yardage indicated in the struck area being doubled as in the case of kickoff and punt returns.

Any strike within the blue area 26B, center right periphery, reflects the interception of the pass and a touchdown for the side making the interception. All strikes in the green partial segments 23G, 29G, are representative of completed passes entitled only to the 2 yards indicated therefor. However, strikes in the respective green circle areas 18G, 22G, 19G, and 25G are indicative of completed passes for the amount of yardage (10, 5, 40, 25), respectively, indicated, plus the yardage of respective bonus throws on dart board 11C. Also, a strike within the white annulus 24W is representative of a 3 yard gain on a completed pass plus the yardage of a bonus throw on the dart board 11C. A strike in the center green of "bull's eye" area 22G is representative of a completed pass and touchdown.

Referring now to the dart board 11R, the 3 o'clock line is designative of the yard line on which kickoff is received, the kickoff scale being set forth from white center 53W (goal line) and on through numeral designations 5, 10, 20, 30, and 40 in successively outwardly annuli 52B, 51W, 50B, 49W, and 48B. In case the kickoff strike is in any of the white areas 10, 50, 55, or 31–40 of the annulus 51W, the ball is represented as received on the 10 yard line. If the strike is in any of the blue E.Z. areas of the annulus 51W, the ball is represented as having been kicked off into the end zone. In this case, the receiver has the option of electing to run the ball back by the rules as to run backs and returns as applicable in throwing at the target areas of dart board 11C. Otherwise, he can elect that his team begins first down throw at the board 11C with the ball on his 20 yard line. In case the throw representative of the kickoff misses the dart board 11R altogether, the thrower is entitled to another throw, with 5 yards being added to each of the yardage representing numerals along the 3 o'clock line.

In case the thrower may elect to call a quick kick, permitted only on first, second, or third down, the 9 o'clock scale on the dart board 11R is shown with successively inwardly annuli 49W, 50B, 51W, 52B designating quick kicks of 40, 45, 55, and 65 yards, respectively (70 yards, center 53W). In the case of quick kicks, these are selected when opponent, and probably the thrower, have been having difficulty making progress throwing darts to hit yardage awarding target areas on dart boards 11L and 11C. It can be seen that these can result in making substantial change in the position of the ball. This is true because it requires little accuracy to hit at least within the white annulus 49W. On the other hand, the ball goes to the other side at the yardage designated from the line of scrimmage; there is no quick kick run back or return permitted under the rules for this game as now visualized. However, if the thrower is very inaccurate, and his quick kick lands outside of the white annulus 49W, or in blue annulus 48B or off the board, the result is representative of a fumble. In this case, both players throw, as aforesaid, with the one striking nearest the center 42W of the board 11C being considered as having recovered the ball. If the team quick kicking is determined to have recovered, it is automatically fourth down at the line of scrimmage from which the quick kick was endeavored.

In the case of the thrower electing to call for a field goal, the 12 o'clock line on the dart board 11R indicates that if the line of scrimmage shows the offensive team within the 10 yard line, its throw need strike only in the outer blue annulus 48B to entitle it to be awarded a field goal. If such line of scrimmage is successively inwardly by the successively inwardly yard line designations 11–20, 21–30, 31–40, and 41–50, a strike representative of a successful field goal will have to fall within the respective annuli 49W, 50B, 51W, and 52B. A field goal may not be attempted if the line of scrimmage is further than fifty yards from the goal line. If a field goal try fails, the ball goes over to the other side on its 20 yard line; if it succeeds, the scoring team kicks off.

For a point after touchdown the thrower, who has just completed a touchdown, must throw the dart to strike at least within the white annulus 49W, or anywhere inwardly thereof. If election is made to try for two points after touchdown by running, the dart thrower must strike within the green areas of dart board 11C representing a gain of 3 yards or more, or in any of the white areas thereof. If election is made to try for two points after touchdown by passing, the dart thrower must strike in green annulus 18G in dart board 11L, or in green circles 22G, 19G, or 30G, or in white annulus 24W or in white circle 17W, all of such target areas being representative of three yards or more gained.

As aforesaid, a strike in the green center 22G of dart board 11L or in the white center 42W of dart board 11R represents a touchdown. In case a dart strikes in the border line between areas, the party whose throw-off strike is nearer the center of the white 42W circle of the dart board 11C wins decision as to the disputed yardage. In the case of a safety, as when the thrower starting on a yard line down in his territory keeps striking red areas on dart board 11C to subtract yardage to place him on, or behind, his own goal line, the other side is awarded 2 points. The team against which a safety has been scored keeps the ball and kicks off. The safety kickoff is scaled along the 3 o'clock line of dart board 11C, but 25 yards is added to the respective receipt of kick figures in favor of the receiving and against the kicking off team. Thus, a kickoff after safety strike may strike in the white annulus 99W. The amended line of receipt of the kickoff is advanced 25 yards to the 45 yard line of the team that has just kicked off after a safety has been made against it.

Whether relatively high scoring or low scoring games result depends upon the distance between the dart boards and the player throwing position line. Naturally, the further from target boards, the more difficult to hit the smaller area (higher awards) targets. The length of play may be predetermined, as 15 minutes per quarter. Also, termination can be set, not on time, but when one side attains a certain score, or when one team gets a predetermined score ahead of the other. Or the end of quarters may be predetermined to end when so many plays had taken place.

As shown in FIG. 1, the YARDAGE AND SCOREBOARD 15 is shown as having a left end zone 54 and a right end zone 55. These zones show figuratively a louver construction comprised of parallel extending, sloped, alternate black and white bars or areas b, w. At the top of each end zone a plaque is provided, left numbered 6-1 3-2, and right numbered 2-3 1-6. Vertical lines, centrall, divide the respective end zore louvers or grids into two parts. Beneath each end zone, four aligned pins 56 are provided, and from the center of the board outwardly these pins have alternately white and black heads. Also, a larger pin 57 is shown off the right end of the board 15 in FIG. 1, having a larger head which can be of a color adapted to fluorescent reflection, as orange or red. The pin 57 is placed at successive positions along the board 15 reflective of the position of the football for the beginning of play. The pins 56 are used to keep score. A black headed pin may be placed in the successively higher white spaces of each end zone, below its numeral 6, to denote scored touchdowns, while an inwardly adjacent white headed pin under the numeral 1 may be placed in the successively higher black spaces below numeral 1 to denote single points after touchdowns. Also, a black headed pin may be placed in successively higher white spaces below the numeral 3 to denote field goals, while an inwardly adjacent white headed pin may be placed in successively higher spaces below the numeral 2 to denote safeties, or 2 point scores after touchdowns.

As shown in FIG. 2, a conventional dart 58 represents the single dart ordinarily in use by the participant who represents the quarterback of the team on offense. Also, a dart 59 is shown in dotted lines, as when the opposing sides throw to determine which side has recovered a fumble (as after a throw has entirely missed the board at which it has been aimed). Or, optionally, one (or two) darts may be left before each board.

A situation not heretofore discussed is that when a yardage gain advances the ball to the goal line, or better, into the end zone. Such condition represents a touchdown on dart boards 11L or 11C, and represents a kick or quick kick going into the end zone on board 11R.

From the foregoing description and drawings, it is seen that the pass plays board, running plays board and kicks dart board each include, at least one colored circular area 17W, 19G, 25G; 42W; and 53W respectively.

The pass plays board, running plays board and kicks dart board also include at least one colored ring 21Y, 18G and 24W; 40W and 41G; 52B, 49W and 48B respectively;

In addition, the dart boards each also include at least one colored segment of a circular area 20R 29G, 23G and 26B; 46W and 47W; and 51W respectively.

Each the pass plays board, running plays board and kicks dart board include at least one circumferentially and radially extending portion wherein a part of such portion is of greater radial extent than the remainder of such portion to define target areas thereon as represented by 31R, 27R, and 32R; 34R, 28R and 33R and 16Y; and 35R, 36R, 43R, 44R, and 45R; 38G, 39G and 37G; and 50B respectively.

Having set forth in detail the pattern of target area arrangements for the aforesaid respective boards, it may be seen that they each aim at presenting target areas of higher rewards interspersed with target areas of loss or too small rewards, in the patterns of the board, so that the general target area of a respective board selected for each play is determined by the particular position (yard line) on which the ball rests as the respective play comes up.

Obviously, boards of other than round shape may be employed, and colors and patterns of areas may vary, but the spirit of the invention includes all arrangements whereby pattern, color, target area shape, and rewards against unfavorable possibilities are such that the dart thrower at time of each respective throw is confronted with problems of choice of target dependent upon his assessment of his skill comparable with an offensive quarterback's appraisal of his team's capabilities. The appended claims are thus by way of illustration and not by way of limitation.

What is claimed is:

1. A football dart board game apparatus comprising:

a. dart board target means for receiving darts therein;

b. said dart board target means consisting of a plurality of aligned dart boards for receiving darts therein;

c. each of said dart boards consisting of at least one colored, circular area defining a dart target area thereon;

d. each of said dart boards also consisting of at least one colored ring defining dart target areas thereon;

e. each of said dart boards also consisting of at least one colored segment of a circular area defining dart target areas thereon;

f. at least one of said dart boards also consisting of at least one circumferentially and radially extending colored portion and wherein a part of such portion is of greater radial extent and of less circumferential extent than the remainder of such portion to define dart target areas thereon;

g. the arrangement of said target areas on one board being different from the arrangement of dart target areas on each other board whereby each board represents a particular type of football play; and h. indications on said colored circular dart target areas, colored ring dart target areas, colored segment dart target areas and on said circumferentially and radially extending colored portion dart target area for indicating the results of various plays which may be made in a game of football when said target areas are penetrated by darts.

* * * * *

UNITED STATES PATENT OFFICE

CERTIFICATE OF CORRECTION

Patent No. 3,979,117 Dated September 7, 1976

Inventor(s) Ronald E. Worsham

It is certified that error appears in the above-identified patent and that said Letters Patent are hereby corrected as shown below:

Col. 3, line 3, "show" should be --shown--

Col. 4, line 63, "12 1/2" should be --12 1/4--

Col. 5, line 39, "41 50" should be --41-50--

Col. 7, line 58, "drt" should be --dart--

Signed and Sealed this

*Thirteenth* Day of *September 1977*

[SEAL]

*Attest:*

RUTH C. MASON
*Attesting Officer*

LUTRELLE F. PARKER
*Acting Commissioner of Patents and Trademarks*